US007357058B1

(12) United States Patent
Olcott

(10) Patent No.: US 7,357,058 B1
(45) Date of Patent: Apr. 15, 2008

(54) SAFETY LATCH ASSEMBLY FOR USE IN A WEAPON BREECH

(75) Inventor: Douglas F. Olcott, Germantown, MD (US)

(73) Assignee: The United States of America, as represented by the Secretary of the Army, Washington, DC (US)

( * ) Notice: Subject to any disclaimer, the term of this patent is extended or adjusted under 35 U.S.C. 154(b) by 515 days.

(21) Appl. No.: 10/906,983

(22) Filed: Mar. 15, 2005

(51) Int. Cl.
*F41A 3/00* (2006.01)
*F41A 19/00* (2006.01)

(52) U.S. Cl. ..... 89/26; 89/27.13

(58) Field of Classification Search ..... 89/26, 89/27.12, 137, 27.13
See application file for complete search history.

(56) References Cited

U.S. PATENT DOCUMENTS 994,703 A * 6/1911 Dawson et al. ..... 89/27.13
1,273,860 A * 7/1918 Holmstrom ..... 89/27.13
1,336,093 A * 4/1920 Schneider ..... 89/27.13
2,473,555 A * 6/1949 Weiss ..... 89/26
3,044,364 A * 7/1962 Reepmeyer ..... 89/27.13
3,951,041 A * 4/1976 Bartolles ..... 89/27.13
4,597,212 A * 7/1986 Jennie ..... 42/41
4,991,490 A * 2/1991 Balbo et al. ..... 89/24
6,131,325 A * 10/2000 Kefer ..... 42/70.05
7,228,779 B2 * 6/2007 Van Dyke-Restifo et al. ..... 89/27.13

* cited by examiner

*Primary Examiner*—Victor Batson
*Assistant Examiner*—Daniel J Troy
(74) *Attorney, Agent, or Firm*—John F. Moran

(57) ABSTRACT

A safety latch assembly locks a firing tray mechanism and prevents it from firing a primer prematurely if a breech is not safely closed. The safety latch assembly includes a latch body, a latch hook for locking a firing mechanism tray, and a shaft that connects the latch body to a housing. A torsion spring is secured to the shaft, to bias a first pin towards the firing mechanism tray. A second pin couples a circular rack to the firing mechanism tray.

8 Claims, 8 Drawing Sheets

SAFETY LATCH ASSEMBLY FOR USE IN A WEAPON BREECH

FEDERAL INTEREST STATEMENT

The inventions described herein may be manufactured, used, and licensed by, or for the U.S. Government for U.S. Government purposes.

FIELD OF THE INVENTION

The present invention relates in general to weapon firing safety. More particularly, the present invention relates to a safety latch assembly for use in a canon breech.

BACKGROUND OF THE INVENTION

The safety of the soldiers in the field is high on the priorities of weapons design. Not only are soldiers constantly exposed to enemy fire and a hostile environment during battlefield engagement, they are also exposed to the firing hazards of their own weapons and launch equipment. Often times, the launch equipment and munitions may be worn out or become unsafe due to intense use, operator error, improper maintenance or poor weather conditions, resulting in an increase of potential hazards to the soldiers. It is therefore an important goal to minimize the potential hazards to soldiers operating weapons in the field despite such real world adverse conditions.

In one conventional design of an artillery gun, the recoil buffering mechanism for the artillery gun comprises a breech assembly and a barrel, wherein the barrel and breech do not provide any special safety design for the operator standing behind the breech to fire the artillery gun. This configuration leaves the operator fully exposed to the dangers of explosives and hot combustion gases leaking from the gun in case the breech accidentally opens during the gun firing.

More specifically, when the breech is in an open position, the munition is loaded axially into the firing chamber. To perform this operation, the operator positions himself or herself at a distance from the breech. Next, the breech is closed in preparation for firing. Since the firing event is accomplished almost instantaneously, the operator remains at the distal position, behind the breech, during the entire firing operation.

A significant pressure rise results from firing the munition. It is necessary for the breech to remain safely closed during the firing in order to impart the maximum forward momentum to the projectile, and to prevent any of the explosives and hot combustion gases from leaking past the breech to cause harm to the operator along the leakage path.

However, due to wear, debris or other unforeseen factors, the breech might not be fully closed prior to, or during the firing of the weapon, resulting in leakage of explosives and hot combustion gases from the barrel to a position distal to the breech where the operator is positioned. This exposure increases the hazard of the operator and could pose substantial danger to operator safety.

In one embodiment, of a safety and arming mechanism for a rifled gun, the mechanism is controlled by three projectile parameters. The first and second parameters are the axial and angular accelerations of the fired projectile, which move a setback ball to arm the mechanism. The third projectile parameter, i.e., angular velocity, is utilized to lock the setback ball in the armed position. As the projectile continues its flight, it only becomes armed when a spin actuated escapement mechanism is moved to a fully armed position. In addition, a command arm signal is required to release the arrangement such that the escapement mechanism is in a condition to complete its motion to the fully armed position.

Such weapon arming safety design is implemented in the munition only and not in the launch equipment. It does not explicitly address safety against explosive hazards or firing hazards at the point of firing in case a catastrophic failure occurs, as in the case of firing artillery rounds, and the breech suddenly becoming loosened from the closed position, leaking explosives and hot combustion gases behind the breech.

Another conventional safety-and-arming device is based on micro-electromechanical system (MEMS). Two independent mechanical locks are moved out of the way to allow the arming slider to remove a barrier in the explosive train to arm a fuze or close a switch for firing. The mechanical locks respond only to valid launch or deployment conditions. In addition, the mechanism does not explicitly address safety against explosive hazards at the point of firing in case a catastrophic failure occurs.

In yet another conventional device, a projectile is launched with on-board linear acceleration sensors to measure at least two accelerations, and the recorded time interval between the two accelerations would need to fall within a pre-determined range in order to arm the munition for detonation. This device assures the safety of arming the munition as long as the launched projectile achieves target values in flight parameters. When this goal is not achieved, the munition in flight would not be allowed to detonate. However, this device deals with the safety to arm the projectile after becoming airborne, and not with the safety of the weapon system during the firing process to protect the weapon operators.

In still another embodiment, a firearm safety locking mechanism prevents accidental or unauthorized use of the weapon. The safety locking mechanism is placed and operates in the firing chamber or in the barrel of the weapon. One of the goals of this mechanism is to prevent accidental use by an under-aged operator. However, such mechanism does not address the firing hazard reduction in case the firing chamber fails to hold the hot explosive gases in place inside the weapon.

Although these conventional technologies have proven to be useful, the issue of safety at the point of firing has not been addressed, and it would be desirable to present additional improvements to further reduce firing hazard. What is needed is an artillery gun equipped with a breech having a mechanism to safeguard against premature firing of munitions before the breech is fully closed. The safety mechanism should prevent explosives and hot combustion gases from the primer and the charge from quickly leaking from the firing chamber past the breech and subjecting to harm any personnel in the path of leakage. The need for such a safety mechanism has heretofore remained unsatisfied.

SUMMARY OF THE INVENTION

The present invention satisfies this need, and presents a safety mechanism (also referred to herein as "the mechanism" or "the present mechanism") for safeguard against premature firing of munitions before the breech is fully closed. In the event that explosives and hot combustion gases from the primer and the charge quickly leak from the firing chamber past the breech, the mechanism minimizes the firing hazard to any personnel in the path of the leakage.

The present invention reduces the firing hazard of personnel operating in the vicinity of weapons, and in particular it reduces the firing hazard of personnel firing munitions from behind the breech of the weapon.

One feature of the present invention is to reduce the firing hazard to the operator when the breech does not remain fully closed during the firing of munitions in an artillery gun, with explosives and hot combustion gases leaking from the firing chamber past the breech to behind the weapon.

BRIEF DESCRIPTION OF THE DRAWINGS

The various features of the present invention and the manner of attaining them will be described in greater detail with reference to the following description, claims, and drawings, wherein reference numerals are reused, where appropriate, to indicate a correspondence between the referenced items, and wherein:

FIG. 6 is comprised of FIGS. 6A and 6B, wherein

FIG. 7 is comprised of FIGS. 7A and 7B, wherein

DETAILED DESCRIPTION OF PREFERRED EMBODIMENTS

Figure 1:
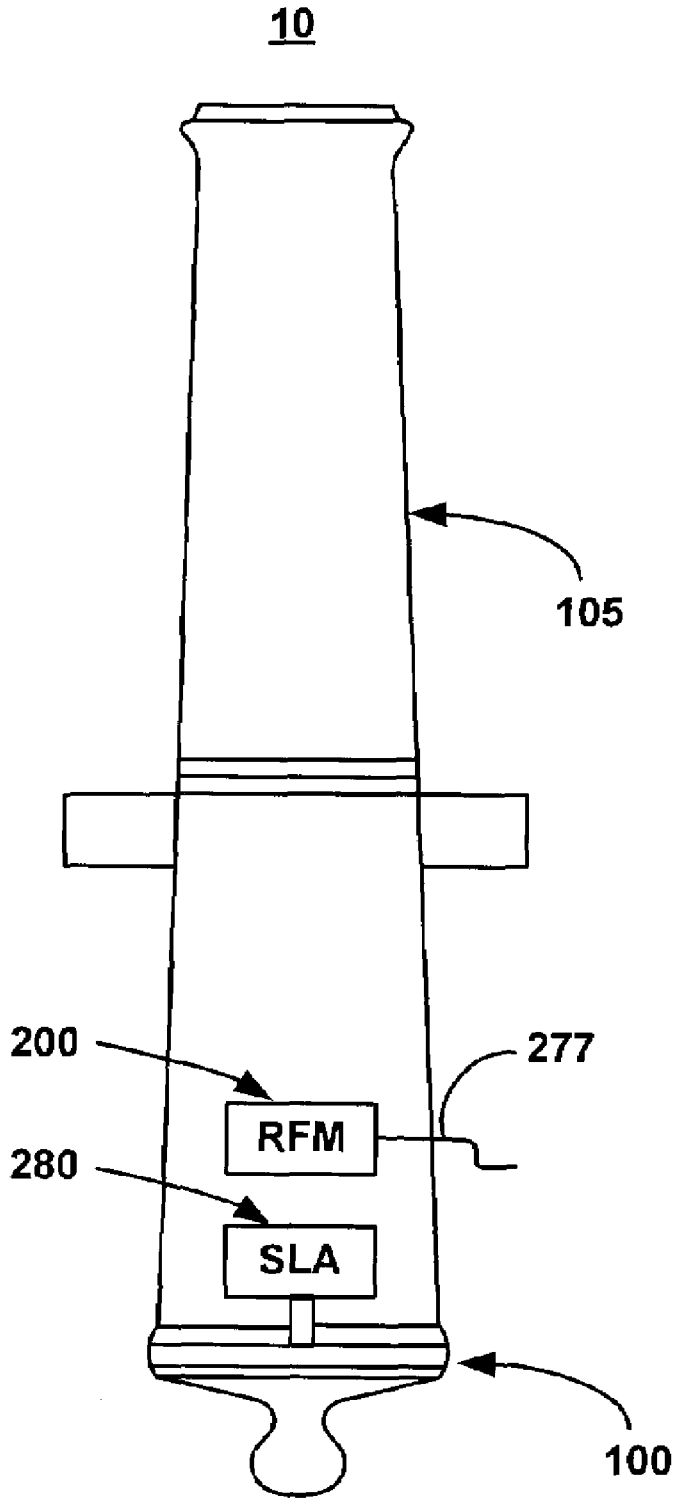
FIG. 1 is a top view of a weapon fitted with a remoter firing mechanism (RFM) and a safety latch assembly according to the present invention.

FIG. 1 is a top view of a weapon or artillery gun 10, showing a breech 100 that is axially aligned with a weapon barrel 105, shown in a closed position. The breech 100 is positioned at the trailing end of the barrel 105. When the breech 100 is an open position, it allows munitions to be loaded into a firing chamber of the weapon 10. When the breech 100 is in a closed position, it enables the firing of the munitions loaded in the firing chamber. In general, there are two common types of breeches: the sliding block mechanism and the screw block mechanism.

In a preferred embodiment of the present invention, the artillery gun 10 is fitted with a remote firing mechanism (RFM) 200 and a safety latch assembly 280 that are positioned on the artillery gun 10.

The remote firing mechanism 200 enables the operator to fire the artillery gun 10 from a position other than behind the breech 100. The operator's position is preferably on the right of the gun barrel 10. In the event that the breech 100 does not remain fully closed during the firing, explosives and hot combustion gases leaking out past the breech 100 do not cause potential harm to the operator whose position is farther away from the harmful burst of materials.

Figure 2:
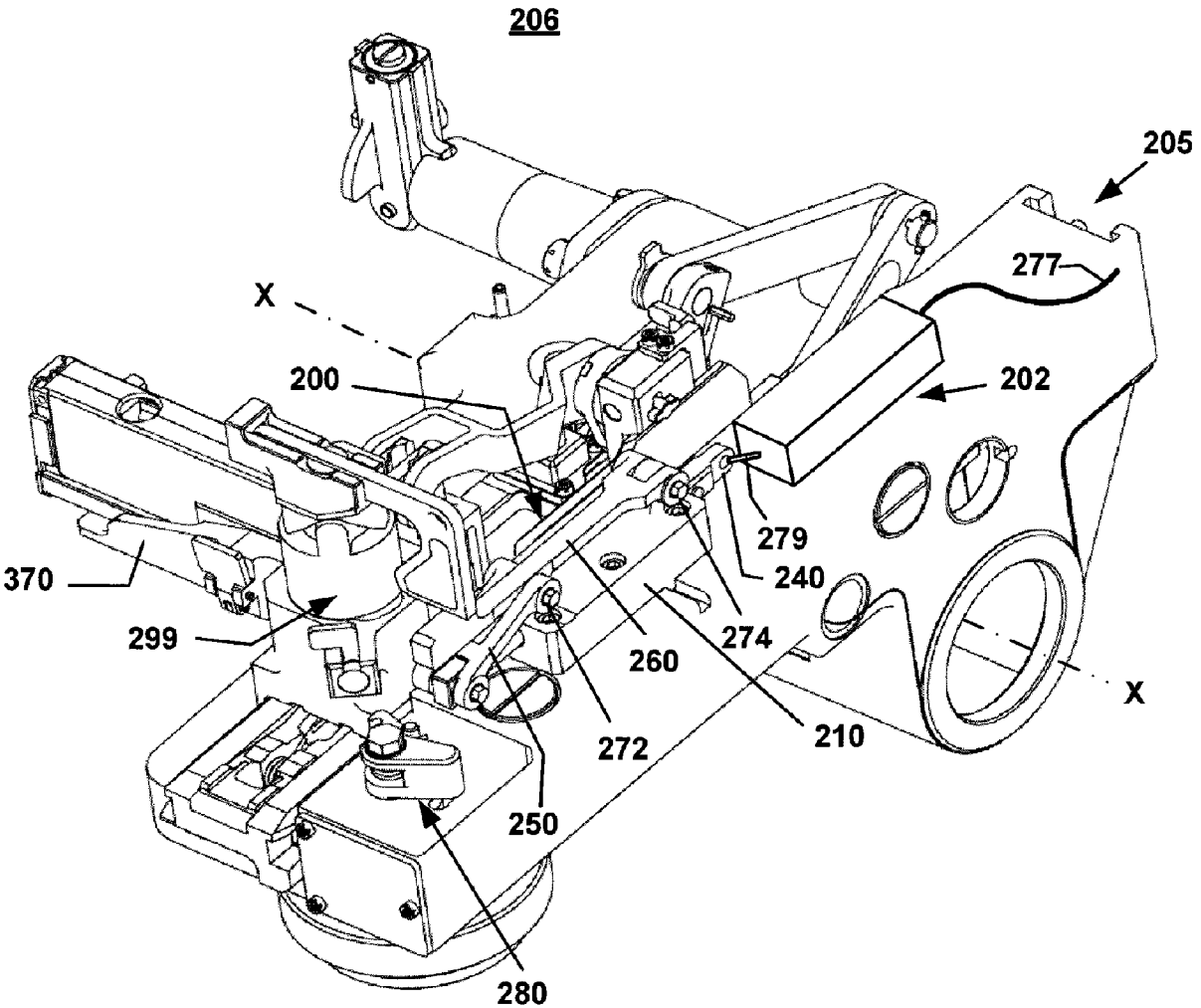
FIG. 2 is an isometric view of a carrier assembly that forms part of a breech of the weapon of FIG. 1, shown fitted with the remote firing mechanism and the safety latch assembly.

FIG. 2 is a perspective view of a carrier assembly 206 that forms part of the breech 100, shown fitted with the remote firing mechanism 200 and the safety latch assembly 280, according to the present invention. The safety latch assembly 280 is also known as the tray latch assembly.

In this particular exemplary embodiment, the remote firing mechanism 200 is disposed so that firing could take place from the right side of the artillery gun 10. With the operator standing on the right side of the artillery gun 10, the remote firing mechanism 200 and the associated linkage mechanism 202, provide the necessary linkage to actuate a connector 240 on the carrier assembly 206, in order to initiate the firing sequence.

The carrier assembly 206 is secured to the artillery gun 10, and includes a housing 205. The housing 205 pivots around an axis of rotation X-X. The pivot axis X-X lies orthogonally to the axis of the gun barrel 105 and is substantially parallel to the ground level on which the artillery gun 10 stands.

The remote firing mechanism 200 comprises a base 210, a shaft 220, a spring 230, a connector 240, a lower link 250 that terminates at rotation points 272, 273, an upper link 260 that terminates in a shoulder 274 and a return point 272.

The connector 240 is positioned at the proximal end of the base 210, and is tied or coupled to the linkage mechanism 202, which, in turn, is controlled by an operator via a cable or lanyard 277. The linkage mechanism 202 is shown as a block, and is comprised of a series of linkages and springs and that is connected to the connector 240 by means of a tie 279. The lanyard 277 is connected to the linkage mechanism 202 for the operator's use.

The forward pivot pin 274 is mounted on the upper surface of base 210, behind the connector 240. The forward pivot pin 272 provides pivotal support for a longitudinal bar referred to as the upper link 260 on the upper surface of base 210. The upper link 260 extends beyond the distal end of the base 210, and terminates in a block having a raised upper surface. The upper link 260 is spring biased towards the housing 205 by means of an underlying spring 230 mounted on the shaft 220 that is secured to the housing 205.

On each side of the upper link 260, a longitudinal lower link 250 comprising two simultaneous side members, is attached to the upper link 260 by means of the rear pivot 273 that has its axis of rotation perpendicular to the axis of the gun barrel 105. The lower link 250 is spring biased to adopt a downward slanting angle towards the distal end of the base 210.

Figure 3:
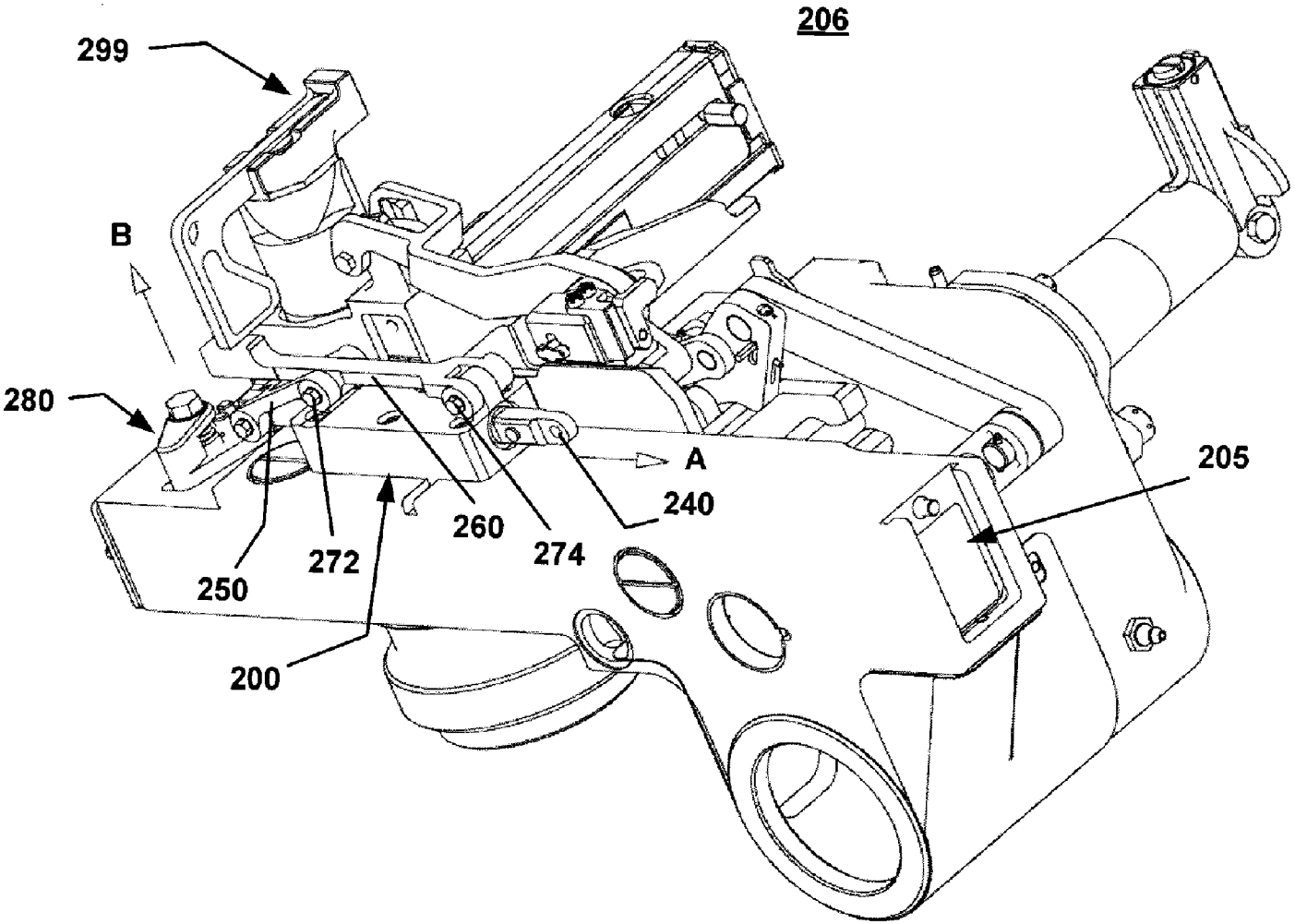
FIG. 3 is another isometric view of the carrier assembly of FIG. 2, further illustrating the remote firing mechanism and the safety latch assembly.
Figure 4:
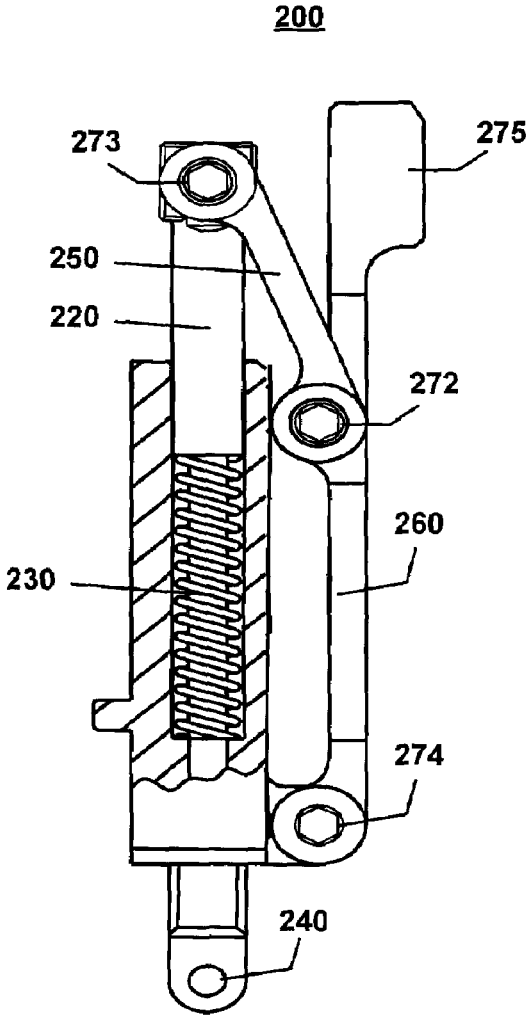
FIG. 4 is a side, partly cross-sectional view of the remote firing assembly of FIGS. 2 and 3, shown in a standby, non-activated position.
Figure 5:
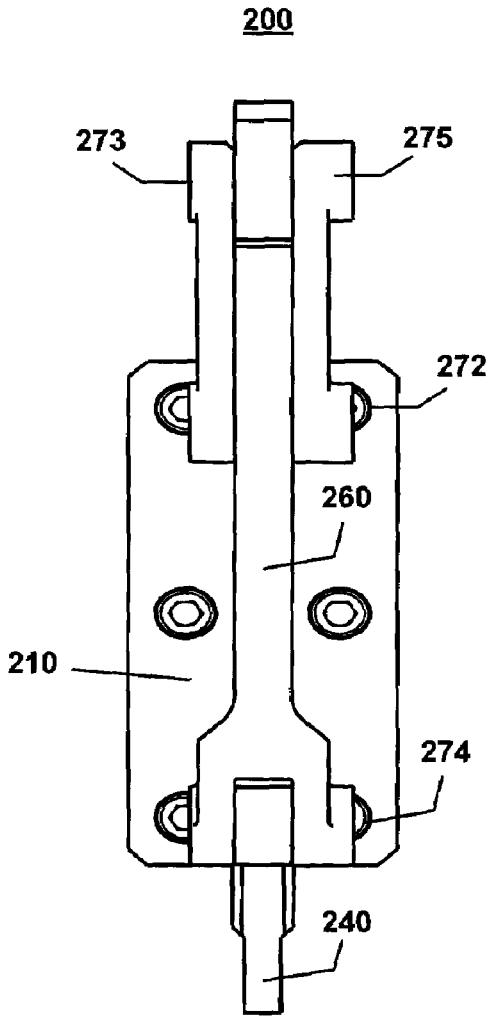
FIG. 5 is a top view of the remote firing assembly of FIG. 4.
Figure 6A:
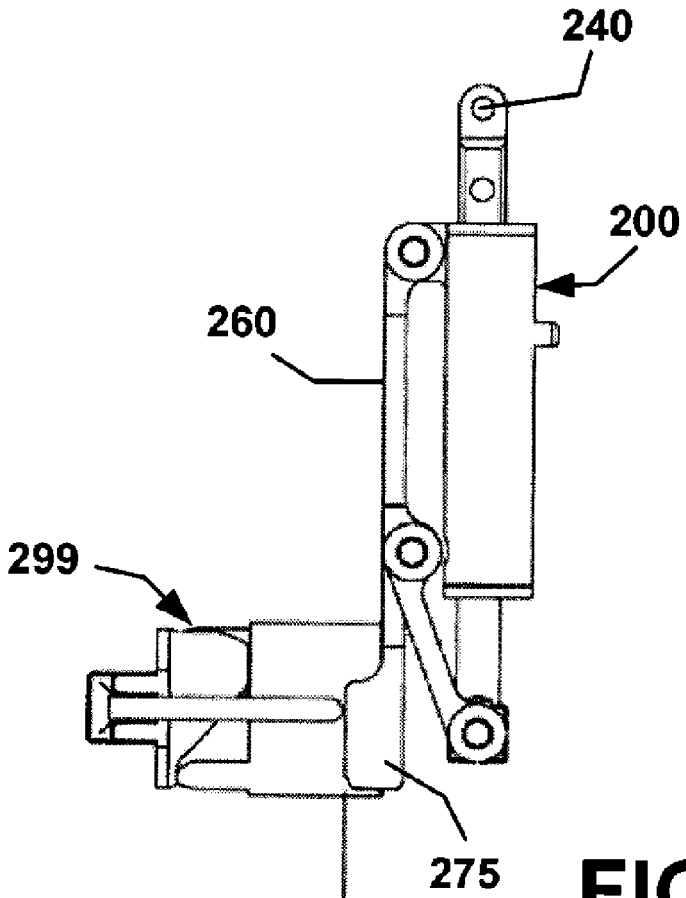
FIG. 6A is a side view and FIG. 6B is a bottom view of the remote firing assembly of FIGS. 4 and 5, shown in an non-activated position, adjacent a firing mechanism.
Figure 6B:
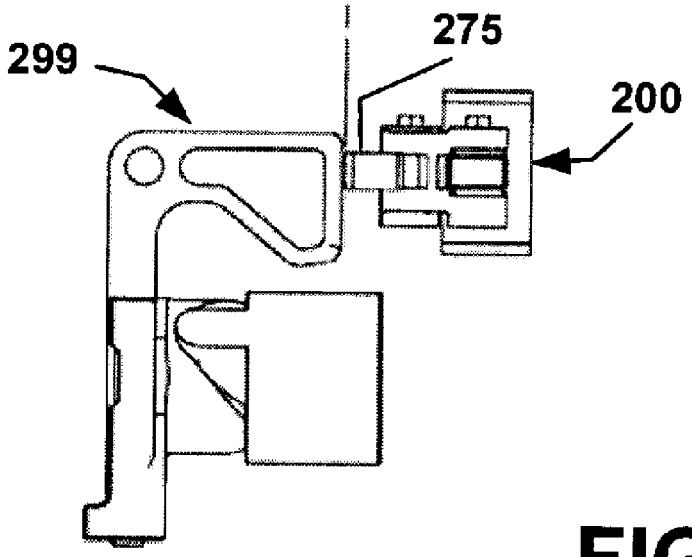

FIG. 3 is another perspective view of the carrier assembly 206 of FIG. 2, shown fitted with the remote firing mechanism 200 and the safety latch assembly 280.

The safety latch assembly 280 comprises a latch body 320 (FIG. 9), a left protruding latch hook 350, a support shaft 290 with a biasing torsion spring 300, a straight headless right pin 310 under counterclockwise bias, and a left pin 811 (FIG. 8) that is lockable with a firing mechanism tray's circular rack 360.

The latch body 320 of the safety latch assembly 280 is mounted onto a tray latch support shaft 290 that is biased counterclockwise by the torsion spring 300. The torsion spring 300 wraps around the support shaft 290 and has two extensions whose interior angle is defined by a straight headless pin 310 on the right side and another pin 340 on the left side, both mounted onto the latch body 320. The latch body 320 terminates on the left with a latch hook 350 whose hook faces the breech 100 on the distal end of the artillery gun 10.

Figure 7A:
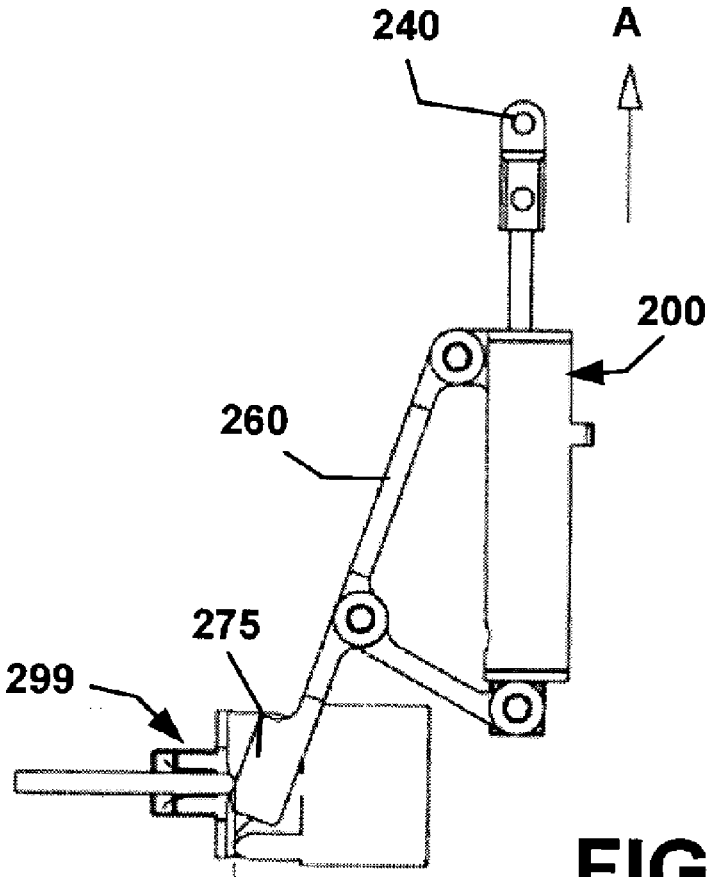
FIG. 7A is a side view and FIG. 7B is a bottom view of the remote firing assembly of FIGS. 6A and 6B, shown in an activated position, adjacent the firing mechanism.
Figure 7B:
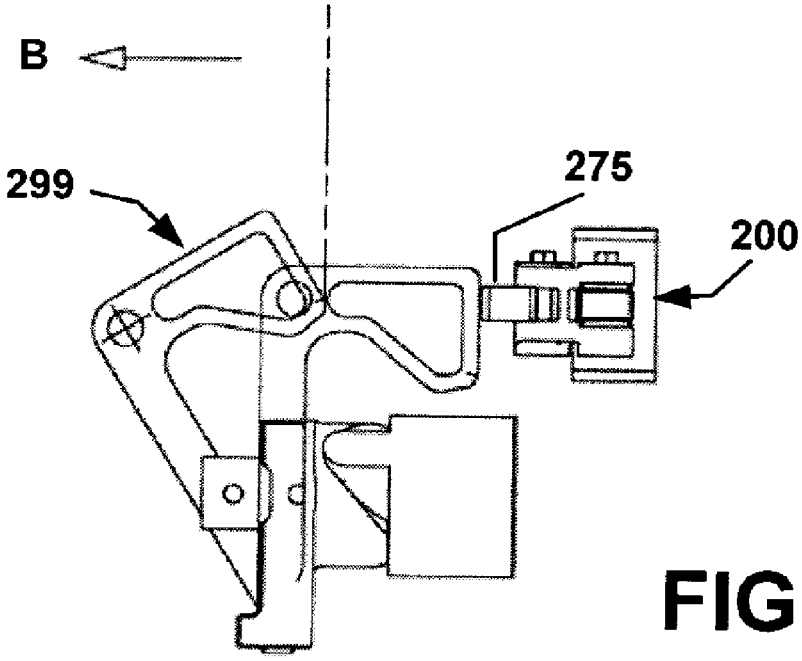

The operation of the remote firing mechanism 200 will now be explained in connection with FIGS. 4 through 7. The operator opens the breech 100 to load the munition or cartridge into the artillery gun's firing chamber, closes the breech 100 safely against the firing chamber, and takes a position on the right side of the gun barrel. Next, the operator pulls on a cable or lanyard 277 (FIGS. 1 and 2). The lanyard 277 is connected to the linkage mechanism 202, which, in turn, pulls on the connector 240 of the remote firing mechanism 200, in the direction of arrow A (FIG. 7A). This action results in pulling the upper link 260 upward (in the direction of arrow B, FIG. 7B), to compress a spring for releasing the plunger 380 to push the firing pin 375 forward, in order to fire the primer on the munition or cartridge in the firing chamber.

In this embodiment, the remote firing mechanism 200 and the linkage mechanism 202 enable the operator to fire the weapon 10 remotely, that is, from a position other than behind the breech. Once the weapon 10 is fired, the weapon returns it to its battery position. The breech 100 opens up for loading a new munition or cartridge into the firing chamber. As it will be explained later in more detail in connection with FIGS. 8 and 9, the safety latch assembly 280 rotates counterclockwise to place a latch hook 350, in order to lock a firing mechanism tray 370 and to prevent it from moving forward to launch a plunger 380 into the firing pin for the primer.

Figure 8:
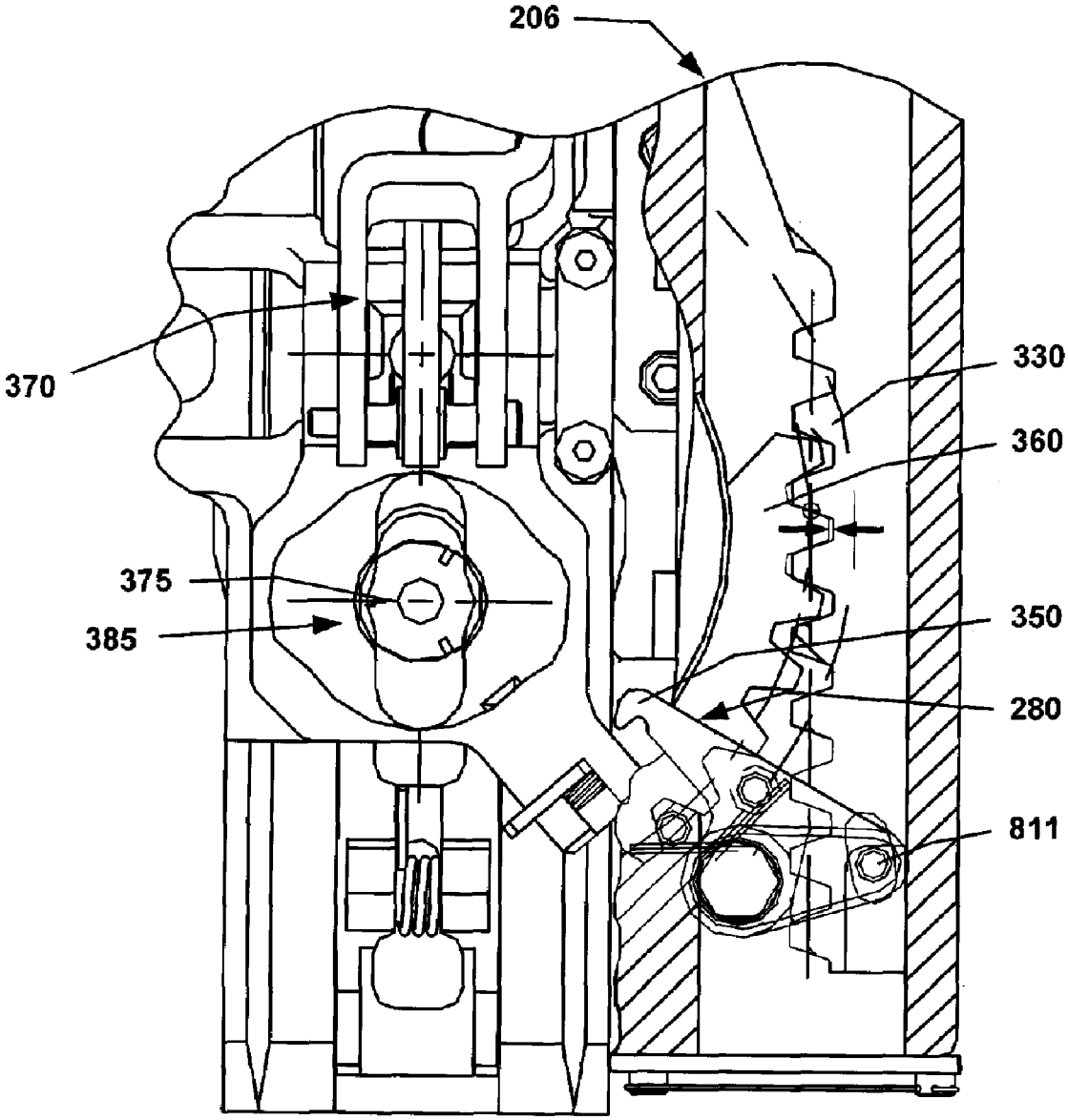
FIG. 8 is a partial, top, partly cross-sectional view of the safety latch assembly of FIGS. 2 and 3, shown in an unlocked position.

FIG. 8 is a top view of the safety latch assembly 280 shown in an unlocked position, mounted onto the carrier assembly 206. A stationary linear rack 330 is fixed to the carrier assembly 206 below the housing 205, proximally to the safety latch assembly 280. The safety latch assembly 280 delivers stable tracked motion by coupling with the gears of a corresponding circular rack 360 driven by the breech 100 as it opens and closes during munitions loading and firing.

The unlocked position of the safety latch assembly 280 corresponds to the breech 100 in a safely closed position against the firing chamber in the artillery gun 10. The breech 100 drives the circular rack 360 to rotate clockwise so that the left pin 811 of the safety latch assembly 280 locks on a matching gear surface of the linear rack 330, due to the counterclockwise spring bias on the safety latch assembly 280.

The pin 811 is pushed to rotate clockwise around the tray latch shaft 290 by means of the linear rack 330, to a position further from the circular rack. Correspondingly, the latch hook 350 of the safety latch assembly 280 rotates clockwise to a position outside the traveling carriage of the firing mechanism tray 370, freeing the firing mechanism tray to move forward.

The operation of the safety latch assembly 280 allows firing the munition only after the breech 100 is safely closed onto the firing chamber of the artillery gun 10. The safety latch assembly 280 prevents premature firing of the primer if the breech 100 is not safely closed, due, for example, to malfunction. Its operation is mechanically driven by a series of steps, and the operational progression is determined by individual timing of each step. This design lends itself to completely manual, semi-automatic, or automatic firing operation.

In the unlocked position, the firing mechanism tray 370 carrying a firing pin 375 to fire the primer slides forward, being driven by a plunger assembly 385 that carries the plunger 380. Upon command to fire, the axially aligned plunger 380 launches forward to hit the firing pin 375, driving it into the primer to set off the charge and fire the munition or round in the artillery gun 10.

The firing mechanism tray 370 and the plunger assembly 385 with a rotating turret onto which the plunger 380 is mounted, travel axially towards the gun barrel via a precise recess imbedded in the carrier assembly 206, guided by the linear track 330.

Figure 9:
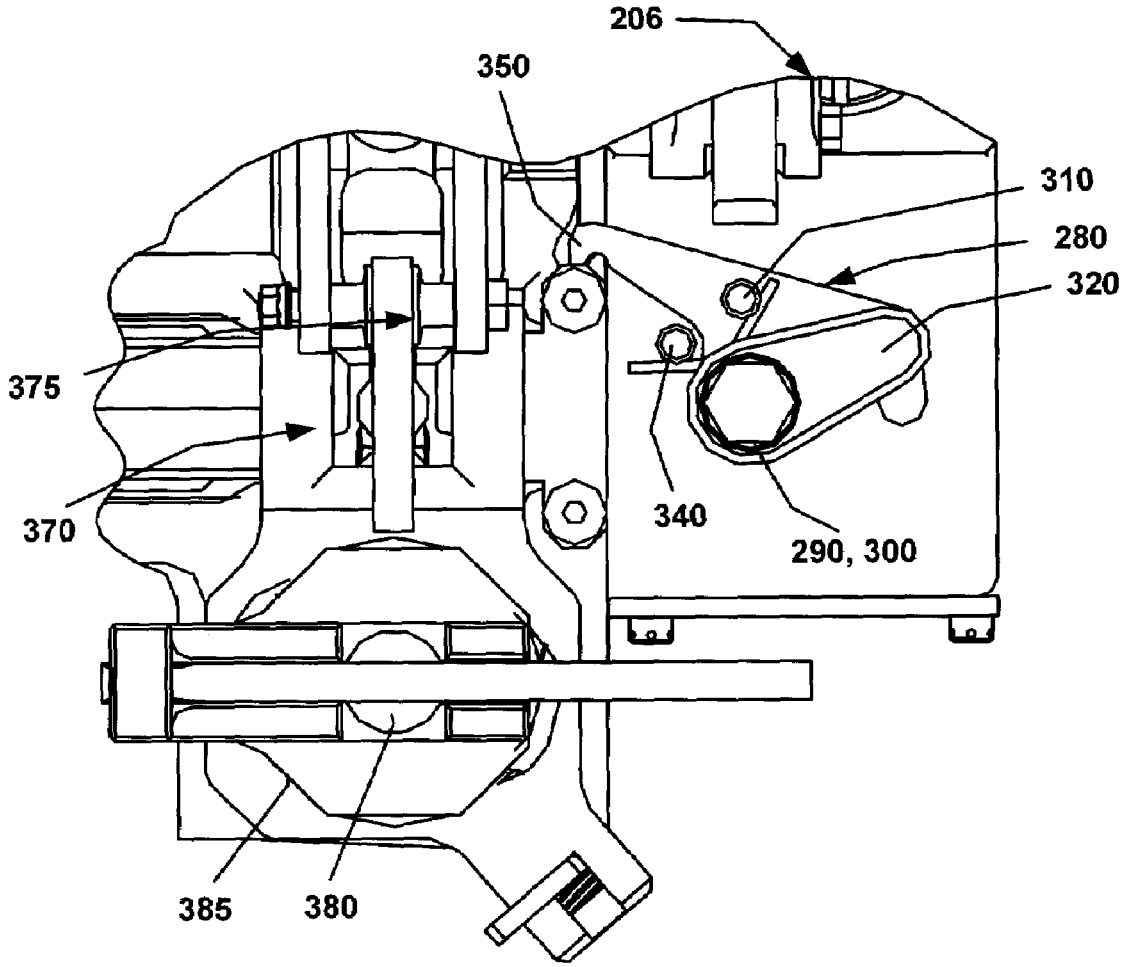
FIG. 9 is a partial, top view of the safety latch assembly of FIG. 8, shown in a locked position.

FIG. 9 is a top view of the safety latch assembly 280 shown in a locked position. As the breech 100 opens to load a munition or a cartridge, the firing mechanism tray 370 is locked by the breech 100, driven circular gear 360.

When the safety latch assembly 280 is in this distal position, the spring biased safety latch assembly 280 is free to rotate counterclockwise for the latch tip 350 to engage and lock the firing mechanism tray 370. The firing pin 375 is spring retracted distally towards the breech, and the plunger 380 is retracted. These steps ensure that the primer of the munition is not prematurely fired before the breech is again safely closed against the firing chamber of the gun barrel 105.

It is to be understood that the specific embodiments of the invention that have been described are merely illustrative of certain applications of the principle of the present invention. Numerous modifications may be made to the remote firing mechanism and safety locking assembly described herein, without departing from the spirit and scope of the present invention.

What is claimed is:

1. A weapon having a breech that includes a carrier assembly, comprising:

a safety latch assembly secured to the carrier assembly for preventing firing operation in the event of a malfunction;

a firing mechanism tray;

a housing secured to the carrier assembly;

the safety latch assembly comprising:

a latch body;

a latch hook for locking the firing mechanism tray;

a shaft connecting the latch body to the housing;

a first pin;

a torsion spring secured to the shaft, to bias the first pin towards the firing mechanism tray; and a second pin that couples a circular rack to the firing mechanism tray.

2. The weapon of claim 1, wherein the circular rack comprises a plurality of gears.

3. The weapon of claim 2, wherein the circular rack is coupled to a linear rack that is fixed to the carrier assembly, below the housing.

4. The weapon of claim 3, wherein the plurality of gears of the circular rack provide a limiting stop to a pin that couples the circular rack to the firing mechanism tray, and place the latch hook out of reach of the firing mechanism tray, when the safety latch assembly is in an unlocked position to facilitate firing.

5. The weapon of claim 4, further comprising a plunger assembly that comprises:

a rotating turret; and a plunger that is biased by spring action to execute a firing command.

6. The weapon in claim 5, wherein premature firing of a primer is prevented if the breech does not close safely against a firing chamber of the weapon.

7. The weapon of claim 6, wherein the carrier assembly further comprises:

a pivotal upper link under spring bias; and a pivotal lower link under spring bias.

8. The weapon of claim 7, wherein the firing mechanism tray comprises:

a tray connected to the breech;

a movable firing pin mounted on the tray; and wherein the tray travels along the recess.

* * * * *